US005556438A

United States Patent [19]

Kardys et al.

[11] Patent Number: 5,556,438

[45] Date of Patent: Sep. 17, 1996

[54] COMPOSITE ABRASIVE PRODUCTS

[75] Inventors: Gary J. Kardys, Wynantskill; Robert G. Kelly, Latham, both of N.Y.

[73] Assignee: Norton Company, Worcester, Mass.

[21] Appl. No.: 310,172

[22] Filed: Sep. 21, 1994

[51] Int. Cl.[6] ..... B24D 3/00

[52] U.S. Cl. ..... 51/309; 51/294

[58] Field of Search ..... 51/294, 295, 307, 51/309; 501/153

[56] References Cited

U.S. PATENT DOCUMENTS

| | | | |
|---|---|---|---|
| 4,011,063 | 3/1977 | Johnston | 51/295 |
| 4,078,340 | 3/1978 | Klecker et al. | 51/295 |
| 4,246,004 | 1/1981 | Busch et al. | 51/309 |
| 4,478,611 | 10/1984 | Seldon | 51/309 |
| 4,623,364 | 11/1986 | Cottringer et al. | 51/309 |
| 4,744,802 | 5/1988 | Schwabel | 501/153 |
| 4,848,041 | 7/1989 | Kruschke | 51/309 |
| 5,201,916 | 4/1993 | Berg et al. | 51/309 |

*Primary Examiner*—Deborah Jones
*Attorney, Agent, or Firm*—David Bennett

[57] ABSTRACT

Composite abrasive wheels having shaped abrasive grits bonded to a fibrous substrate are more effective than their counterparts with irregularly shaped grain, especially at finer grit sizes.

8 Claims, No Drawings

COMPOSITE ABRASIVE PRODUCTS

BACKGROUND OF THE INVENTION

Composite abrasive products, such as wheels or abrading pads, are formed by adhering abrasive particles by means of an organic polymer to the fibers of a nonwoven fiber web. Multiple plies of such webs are then laminated to form a slab from which the products may be cut or the web may be wound spirally to form a log from which products in the form of wheels may be cut. Applications of these widely used abrasive products, usually referred to as "composite abrasives", include polishing, deburring, finishing, and cleaning of metallic parts. They may also find extensive applications in the finishing of wooden furniture.

The abrasive grit is most frequently fused alumina but other grits such as silicon carbide, fused alumina/zirconia and sol-gel alumina abrasive grits have been proposed.

The most commonly used organic binder for use in composite wheels is a polyurethane such as is described for example composite wheels is a polyurethane such as is described for example in U.S. Pat. Nos. 4,011,063; 4,078,340; 4,609,380; 4,933,373 and 5,290,903. Other binders that may be used include acrylic polymers, phenolic resins, melamine resins, polyvinyl chloride and polyvinyl acetate.

DESCRIPTION OF THE INVENTION

The present invention provides a novel composite abrasive comprising a random non-woven fibrous web with abrasive particles adhered thereto by means of an organic polymer characterized in that the abrasive particles are shaped particles of an abrasive material having a substantially uniform cross-sectional shape along a longitudinal axis and an aspect ratio, defined as being the ratio of the length to the greatest dimension perpendicular to that length, of at least 1.5:1.

The material from which the abrasive particles are made can be for example alumina, silicon carbide, alumina/zirconia or any other suitable abrasive that can be formed into shaped particles. The preferred material is a sol-gel alumina formed by a process in which a sol or a gel of an alpha alumina precursor is dried and then fired to convert the precursor to the alpha phase. The precursor may be modified by the presence of seed particles, which generate an extremely fine crystal microstructure, and/or other modifiers known in the art such as magnesia; zirconia; rare earth metal oxides such as lanthana, ceria, samaria and the like; transition metal oxides such as titania, yttria, chromia, iron oxide, cobalt oxide, nickel oxide and manganese dioxide; and silica.

The shaped abrasive grits used in the invention can be made by extrusion or molding of a dispersion of the precursor material, usually in water, and then firing the shaped particles with the desired configuration to convert them to the final abrasive particles.

The shape is frequently and most conveniently basically a right cylinder though other cross-sectional shapes such as triangles, squares, polygons and ovals may often give desirable results. While the cross-sectional shape is consistent, the dimensions may vary to permit a pyramid, truncated cone, needle or other regular shape maintaining a uniform cross-sectional shape may be used.

The abrasive particles may have any desired grit size that is adapted to use with composite abrasives. It is however found that the advantages derived from the use of shaped abrasive grits as taught in this invention are most apparent when the grits are smaller such as from about 120 grit and smaller and more preferably from about 150 grit to about 400 grit. The grit size as used in this specification is measured according to the standard FEPA grits with the largest cross-sectional dimension perpendicular to the length providing the measuring dimension for passage through the apertures of a sieve. The aspect ratio of the abrasive particles can be from about 1.5:1 to about 25:1 but usually the most convenient range is from about 1.5:1 to about 10:1 and more preferably from about 2:1 to 6:1.

The composite abrasive wheels of the present invention may be prepared by appropriate techniques which are well known in the industry. The wheels are typically in the form of a disc or cylinder having dimensions required by end users. The matrix of the abrasive wheels may be either a nonwoven fibrous web or a foamed organic polymer with or without reinforcement.

DESCRIPTION OF THE PREFERRED EMBODIMENTS

The invention is further illustrated by the following non-limiting examples, wherein all parts are by weight unless otherwise specified.

EXAMPLE 1

A 9.4 mm thick, low density, non-woven, fibrous web weighing 95 g/m$^2$ was formed from 15 denier nylon 6—6 fibers on a web-forming machine. The resulting low density web was sprayed with a prebond binder to provide a dry add-on weight of between 40–48 g/m$^2$ using a spraying mix consisting of 55.9% styrene-butadiene latex (sold under the trade name "Tylac 68132" by Reichold Co.), 31.1% water, 10.5% melamine resin (sold under the trade name "Cymel 385" by American Cyanamide Co.), and trace amount of surfactant and acid catalyst. The prebond binder was cured to a tack-free state by passing the sprayed web through a convection oven maintained at 148.8° C. for a dwell time of 3.3 minutes. The resultant prebonded nonwoven web was about 8 mm thick and weighed about 128 g/m$^2$.

An adhesive binder (called first pass binder hereafter) consisting of 28.5% water, 29.2% of a phenolic resin binder available from Bendix Corporation under the trade name BM-11, 0.1% of a defoamer, and 29.1% of Alpine talc as an inorganic filler was used as a saturant for the prebonded web at the dry add-on weight of 1.6 g/m$^2$. While the binder was still tacky abrasive particles were gravity fed to the surface of the web so that the particle stuck to the binder. The add-on abrasive weight was 0.8 gm/m$^2$. The adhesive binder was cured to a tack-free state by passing the saturated web through a convection oven maintained at 160° C. for a dwell time of 8 minutes. The resultant web was about 6.4 mm thick and weighed about 3.3 g/m$^2$.

Sections of the abrasive/binder saturated web were then saturated again with another abrasive/binder mix (called second pass binder hereafter) and partially dried to produce layers called "slabs" for lamination to form composite abrasive wheels.

Fourteen 275 mm square sections of partially dried slabs with the same type second pass binder, were laminated by being placed between two metal plates and compressed to a thickness of 25.4 mm. Then the whole assembly was placed in an oven maintained at 121° C. for one hour. At the end of one hour the metal plates were removed and the cure was continued for another 16 hours. After allowing the cured laminated slabs to cool to room temperature, wheels having a 248 mm diameter and 32 mm center hole were die cut from the 25 mm thick laminated slabs.

Four sets of wheels were produced to compare the performance of the shaped grits from a seeded sol-gel alumina ("SHAPED SG"), having an aspect ratio of 3:1 against a standard fused alumina grit (FUSED A/O) at two different grit sizes. Basically the same production process was used for each except that a different binder was used at the different grit sizes.

The wheels, identified in Table I, were evaluated for grams of metal cut and grams of abrasive grain shed during the cut. The wheels were mounted on the shaft of a Floor Lathe Belt grinding machine adapted to receive the wheels which are mounted on a horizontal shaft driven by a 5 horse power motor. The wheel shaft is driven at 1800 rpm.

A second horizontal driven shaft, parallel to the first, is adapted to receive a cylindrical test piece with a 90 mm outside diameter × 83 mm inside diameter × 90 mm in length and to be urged in the direction of the first shaft by a dead weight of 1362 gm such that the outside diameter of the test piece comes into contact with the wheel being tested. During testing the test piece is also reciprocated in the direction of the axis of rotation to ensure that essentially all parts of the outside diameter are contacted with the wheel.

The test piece is rotated at 9 rpm in the same direction as the wheel and two contact periods of 15 minutes are allowed. The test piece is removed after each period to have its weight and surface finish checked. The test wheel is also measured for reduction in outside diameter.

The result are set forth in Table 1 below.

TABLE 1

| GRAIN | GRIT SIZE | BOND USED | CUT (GM) |
|---|---|---|---|
| SHAPED SG | 180 | V-8020 | 10.4 |
| FUSED A/O | 180 | V-8020 | 1.4 |
| SHAPED SG | 120 | V-B635 | 2.8 |
| FUSED A/O | 120 | V-B635 | 1.5 |

The resins used as the binders were polyurethanes obtained from Uniroyal Chemical Company under the trade designation "Vibrathane" with the indicated descriptor. The shaped grains had a cylindrical cross-section and an aspect ratio of 3:1.

From the above data it can be seen that the wheel with the shaped abrasive particles cut much more aggressively than the standard fused alumina wheels.

What is claimed is:

1. A composite abrasive product comprising a random non-woven fibrous web with abrasive particles adhered thereto by means of an organic polymer wherein the abrasive particles are shaped particles of an abrasive material having a substantially uniform cross-sectional shape along a longitudinal axis and an aspect ratio of at least 1.5:1.

2. A composite abrasive product according to claim 1 in which the abrasive particles comprise a sol-gel alumina.

3. A composite abrasive product according to claim 2 in which the sol-gel alumina is a seeded sol-gel alumina.

4. A composite abrasive product in which the abrasive particles have a grit size of less than 150 grit.

5. A composite abrasive product according to claim 1 in which the shaped abrasive particles have a generally circular cross-sectional shape.

6. A composite abrusive product in which the aspect ratio is from about 2:1 to about 6:1.

7. A composite abrasive product according to claim 1, wherein said product is a wheel.

8. A composite abrasive wheel comprising a random non-woven fibrous web with seeded sol-gel alumina abrasive particles having a grit size of 150 or smaller adhered thereto by means of a polyurethane binder wherein the abrasive particles are shaped particles with a substantially uniform cross-sectional shape along a longitudinal axis and an aspect ratio of from about 2:1 to about 6:1.

* * * * *

UNITED STATES PATENT AND TRADEMARK OFFICE

CERTIFICATE OF CORRECTION

PATENT NO. : 5,556,438

DATED : September 17, 1996

INVENTOR(S) : Kardys, et. al.

It is certified that error appears in the above-indentified patent and that said Letters Patent is hereby corrected as shown below:

Claim 6, Column 4, line 28

Delete "abrusive" and insert ---abrasive---

Insert ---according to claim 1--- after "A composite abrasive product"

Signed and Sealed this

First Day of July, 1997

Bruce Lehman

*Attest:*

BRUCE LEHMAN

*Attesting Officer*

*Commissioner of Patents and Trademarks*